United States Patent [19]

Bentz

[11] 4,198,176

[45] Apr. 15, 1980

[54] CONCRETE EXPANSION JOINT FORMING STRUCTURE

[75] Inventor: Jack Bentz, Boise, Id.

[73] Assignee: Delta National, Inc., Boise, Id.

[21] Appl. No.: 944,701

[22] Filed: Sep. 22, 1978

[51] Int. Cl.[2] ..... E01C 11/04

[52] U.S. Cl. ..... 404/68; 52/396; 249/9

[58] Field of Search ..... 404/68, 47, 50, 51, 404/68, 69, 74, 87, 49, 53, 54, 55; 52/396

[56] References Cited

U.S. PATENT DOCUMENTS

| | | | |
|---|---|---|---|
| Re. 20,378 | 5/1937 | Hall | 404/69 |
| 1,033,431 | 7/1912 | McCarthy | 404/47 |
| 1,644,914 | 10/1927 | De La Mare | 404/47 |
| 1,664,605 | 4/1928 | Fischer | 404/87 |
| 1,730,067 | 10/1929 | Fischer | 404/47 |
| 1,768,838 | 7/1930 | Heztzel | 404/48 |
| 1,891,530 | 12/1932 | Galassi | 404/47 |
| 1,953,846 | 4/1934 | Briggs | 52/396 |
| 2,016,858 | 10/1935 | Hall | 404/68 |
| 2,045,089 | 6/1936 | Kyte | 404/47 |
| 2,100,238 | 11/1937 | Burgess | 404/49 |
| 2,103,339 | 12/1937 | Oury | 52/396 |
| 2,189,437 | 2/1940 | Sandell | 404/48 |
| 2,243,509 | 5/1941 | Prosa | 404/47 |
| 2,265,301 | 12/1941 | Meyer | 404/47 |
| 2,282,335 | 5/1942 | Methven | 404/48 |
| 2,662,342 | 12/1953 | Peterson | 404/68 X |
| 2,806,414 | 9/1957 | Woodman | 404/2 |
| 3,180,238 | 4/1965 | Crone | 404/64 |
| 3,192,577 | 7/1965 | Barr | 52/364 |
| 3,276,335 | 10/1966 | Middlestadt | 404/48 |
| 3,297,294 | 1/1967 | Middlestadt | 249/9 |
| 3,334,558 | 8/1967 | Atkinson | 404/87 |
| 3,335,647 | 8/1967 | Thorp | 404/87 |
| 3,357,324 | 12/1967 | Tone | 404/68 |
| 4,012,159 | 3/1977 | Berry | 404/68 |

*Primary Examiner*—Nile C. Byers, Jr.
*Attorney, Agent, or Firm*—Wells, St. John & Roberts

[57] ABSTRACT

A joint forming structure produced integrally as a bent metallic sheet having a continuous cross-sectional configuration. The sheet includes a central trough having a parallel side walls and a perpendicular transverse base wall. It further includes a pair of oppositely bent longitudinal flanges joined to the respective side walls at their remaining longitudinal edges. The flanges terminate in longitudinal lips bent back along their outer edges and partially overlapping the side walls. The trough is shaped to receive upright supports when inverted over the supports, or alternately, to receive a board or other decorative joint material while upright supports are received within the smaller troughs presented by the flanges and lips at each side of the center trough.

3 Claims, 7 Drawing Figures

CONCRETE EXPANSION JOINT FORMING STRUCTURE

BACKGROUND OF THE INVENTION

This invention relates to the production of concrete expansion joints. It was designed specifically as an inexpensive joint structure for residential concrete projects.

The need for expansion joints in concrete slabs, walks and drives in residential projects is well recognized. However, while rather complicated and expensive joint structures are available for commercial projects, most small projects and residential work utilize rather crude and ineffective joints. For example, wood boards are often used to produce a joint. While wood is initially attractive, it expands by absorbing water from the wet concrete and then contracts as it subsequently dries. This leaves a void space where the wood abuts the concrete at its side surfaces. Surface water can seep through this space, which destroys the joint and erodes the subgrade beneath the concrete.

Felt is another material used with varying degrees of success as a joint material. It also shrinks and allows gaps to be created between the joint and concrete. Furthermore, it is very difficult to hold in a straight condition and is generally recognized as being unsightly because of its incompatibility with concrete and concrete-forming methods.

Both wood and felt make edging with a metal tool very difficult. Both materials swell in contact with wet concrete and create a very tight edging surface.

Metal and concrete make joints that are both effective and attractive. Metal not only provides controlled expansion and cracking in the concrete, but further adds strength to the concrete slab itself. The present structure for forming expansion joints presents a central trough and a pair of oppositely facing side troughs. It can be used with the central trough inverted over supports, or with the central trough facing upwardly to receive a board or other decorative joint material. In either instance, a positive interlock is provided between the metal strip and the concrete slabs at each side of the joint, and a longitudinal trough is provided to receive and direct water along the length of the joint. The joint provides for expansion and contraction of the concrete, as well as for directing water to the edges of the slab.

DESCRIPTION OF THE PREFERRED EMBODIMENTS

Figure 6:
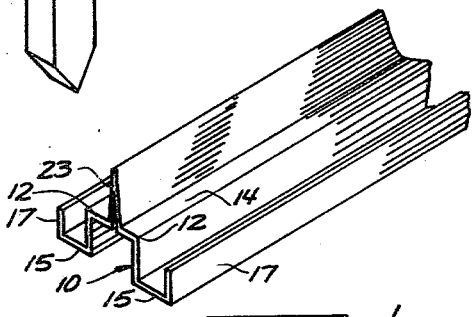
FIG. 6 is a perspective view of a second form of the structure.
Figure 7:
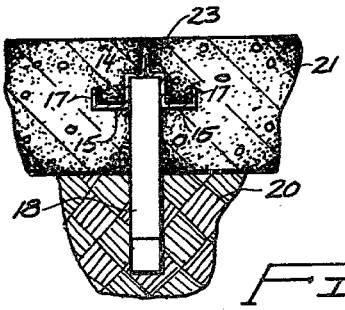
FIG. 7 is a cross-sectional view through a joint produced by the second form.

FIGS. 1 through 5 disclose a first form of the invention. FIGS. 6 and 7 show a second form. The precise details of the structure shown in the drawings is presented by means of example only, and the specific bent configuration of the structure can obviously be modified without varying the novel concept discussed herein.

In the first embodiment shown in FIGS. 1 through 5, the concrete expansion joint forming structure 10 includes a central trough facing in a first direction and a pair of smaller side troughs facing in an opposite direction. This cross-sectional configuration is presented continuously along the length of the structure 10. The bent metallic sheet from which the joint-forming structure is produced includes a central open longitudinal trough of rectangular configuration. This is formed as two identical parallel longitudinal side walls 11. The side walls 11 are spaced transversely apart. Each side wall 11 has a first longitudinal edge 12 and a second longitudinal edge 13. The first edges 12 of the side walls 11 are integrally joined to a base wall 14. The base wall 14 is perpendicular to the side walls 11.

A pair of oppositely bent longitudinal flanges 15 are integrally joined to the side walls 11 at their respective second edges 13. The flanges 15 are bent outwardly from the side walls 11 in directions opposite to the base wall 14. The outer edge 16 of each flange 15 is bent back to form a longitudinal lip 17 that partially overlaps the adjacent side wall 11.

As is evident from the drawings, the joint forming structure 10 includes a central rectangular trough formed between the side walls 11 and base wall 14. It also includes a pair of transversely spaced side troughs which are open oppositely to the central trough. The side troughs are formed between each side wall 11 and the adjacent lip 17, and are spanned by each of the respective flanges 15.

This rather simple bent structure provides a very effective expansion joint for concrete slabs. It can be used in the orientation shown in FIG. 1, or can be inverted as shown in FIGS. 4 and 5.

The joint-forming structure 10 can be placed across a concrete slab prior to pouring of the concrete. It can be set to grade on stakes or posts 18 driven into the supporting soil structure 20 or otherwise fixed with respect to the soil surface. The joint-forming structure is particularly designed for placement over the top ends of wood stakes properly aligned across a slab to a desired grade. Since the lightweight metal structure does not require substantial vertical support, there can be rather wide spacing between the stakes 18. This spacing can permit entry of concrete trucks into the area of the slab and subsequent placement of the structure 10 over the stakes 18 as the concrete reaches the joint location.

Figure 1:
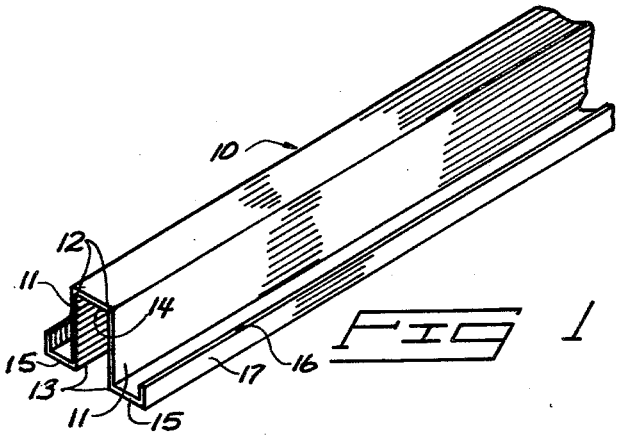
FIG. 1 is a perspective fragmentary view of a first form of the invention.
Figure 2:
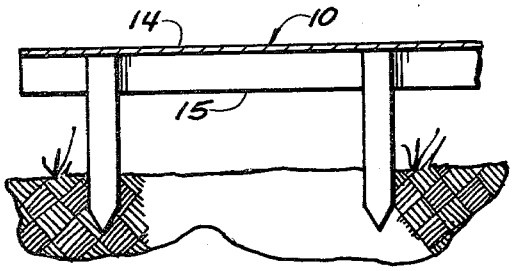
FIG. 2 is a fragmentary side elevation view of the joint supported in the inverted position.
Figure 3:
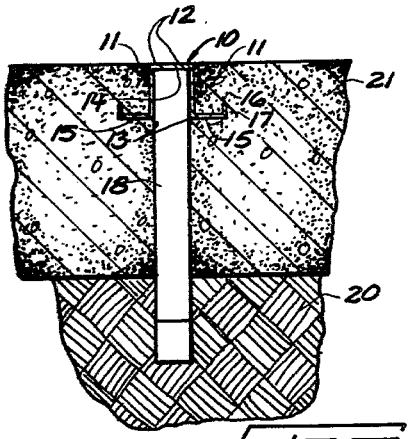
FIG. 3 is a cross-sectional view through a joint.

The top surface of the joint-forming structure 10, which is shown as base wall 14, is preferably set even with the upper elevation of the concrete slab, and serves as a guide for edging tools along the joint area. The final joint is shown in FIG. 3. The concrete 21 is interlocked with joint structure 10 by means of the flanges 15 and lips 17. No separation will occur between these elements and the concrete slab 21 during repeated expansion or contraction of the concrete material. Furthermore, should water seep downwardly along the side walls 11 of the joint-forming structure 10, it will be carried to the sides of the concrete slab by being captured in the side troughs. The water will merely run along the length of the flanges 15 for deposit at the ends of the joint forming structure 10. This prevents water from eroding the subsoil 20 beneath the slab 21.

Figure 4:
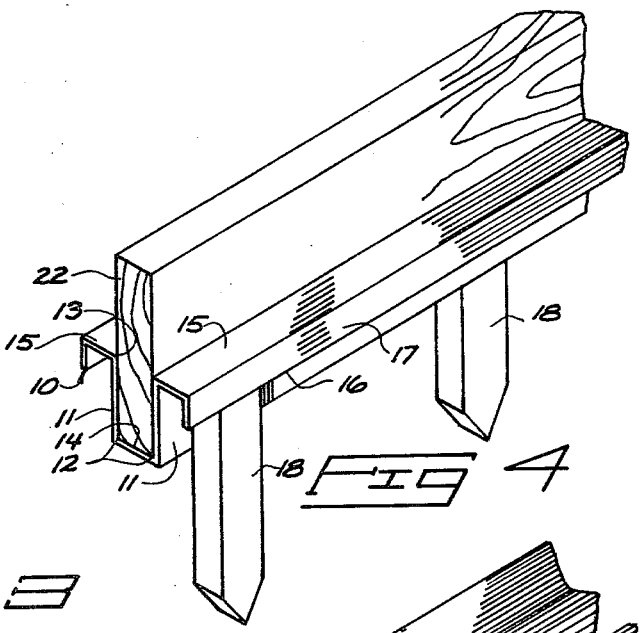
FIG. 4 is a perspective view showing the structure in a second position.
Figure 5:
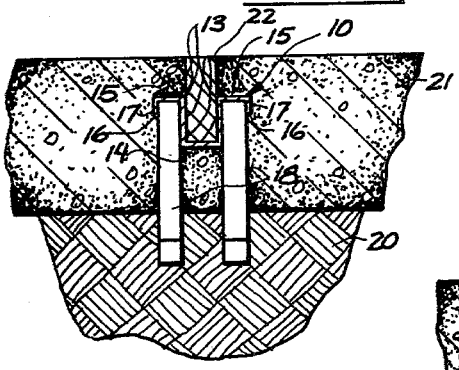
FIG. 5 is a cross-sectional view through a joint with the structure in its second position.

When wood, felt or other decorative material is desired as an exposed joint, the joint-forming structure 10 is used in an inverted orientation shown in FIGS. 4 and 5. It is again supported by posts, stakes or other suitable fixed supports, exemplified by the stakes 18. However, the stakes 18 are now received within the side troughs between the side walls 11 and lip 17. The top ends of the stakes 18 are contacted by the flanges 15. Alternating stakes 18 are preferably received within the two troughs to properly balance and support the joint-forming structure 10 during concrete placement. A board 22 or other suitable joint material is then supported within the central trough of the joint-forming structure 10.

The final joint is illustrated in FIG. 5, with the upper edge of board 22 flush with the upper surfaces along the slab 21. Even though shrinking and cracks might occur between the board 22 and the concrete slab 21, any water entering the slab structure through these voids will be captured within the upwardly open central trough of the structure 10, and will be carried to the sides of the slab along the base wall 14. Again, a mechanical interlock is provided between the concrete slab 21 and the respective flanges 15 and lips 17 at each side of the structure 10.

FIGS. 6 and 7 show a slight modification designed for applications where edging along the joint is not desired. A folded projection 23 is bent outwardly along the center of the base wall 14. The projection 23 extends outwardly from the base wall 14 in a direction opposite to the respective side walls 11. When the modified joint-forming structure is placed over suitable supports, shown as stakes 18, this form of the structure is located elevationally beneath the desired top surface of the concrete slab 21. The recessed projection 23 forms a weakened plane through the concrete slab, which encourages cracking of concrete vertically above the projection 23. This is useful in large interior commercial structures where a critical crack is encouraged in the slab prior to placement of other floor materials, such as tiles. It also might be used in the pouring of exterior drives or slabs where edge tooling is undesirable or unnecessary.

The versatility of this joint forming structure stems from its alternate forms of usage and its design for proper support upon a common width of stakes in each of its alternate orientations. This is accomplished by producing the structure with the base wall 14 and each flange 15 equal in transverse width. Each is therefore adapted to rest accurately on the upper ends of common supports, such as the illustrated stakes 18.

It is evident from this disclosure that the joint-forming structure shown in the drawings can be produced very economically and used without complication or modification of normal slab-pouring procedures. This structure is particularly adapted to small residential projects where more elaborate commercial methods and equipment are not justifiable.

Having described my invention, I claim:

1. A concrete expansion joint-forming structure comprising:

an elongated bent metallic sheet having a constant cross-sectional configuration presented continuously along its length;

said sheet including a central open longitudinal trough of rectangular configuration having two identical parallel longitudinal side walls spaced transversely apart, each side wall having first and second parallel longitudinal edges, the respective first edges of the side walls being integrally joined to a base wall perpendicular to the side walls;

a pair of oppositely bent longitudinal flanges integrally joined to the respective side walls at the second edges thereof, said flanges being bent outwardly from the side walls in directions opposite to said base wall;

a longitudinal lip bent back along the outer edge of each flange and partially overlapping the side walls, the height of each lip being less than the height of the adjacent side wall overlapped thereby;

each of said side walls, base wall, flanges and lips being continuous and uninterrupted throughout the length of the bent sheet;

whereby the joint forming structure may be fixedly supported from beneath prior to pouring of a concrete slab at each side thereof by placing the inverted trough upon upright supports received therein with the base wall set even with the intended upper surface of the slab or alternatively by resting the flanges upon upright supports with the trough in an upwardly open orientation, recessed beneath the intended upper surface of the slab for receiving an exposed joint material, to thereby provide a metal expansion joint interlocking the subsequently poured concrete having a continuous uninterrupted trough configuration for carrying water to the side of the resulting poured structure.

2. An apparatus as set out in claim 1 further comprising:

a folded projection bent outwardly along the center of the base wall and extending outward therefrom in a direction opposite to said side walls.

3. An apparatus as set out in claim 1 wherein the base wall and each flange are identical in width.

* * * * *